US012186619B1

(12) United States Patent
Smith, Jr.

(10) Patent No.: US 12,186,619 B1
(45) Date of Patent: Jan. 7, 2025

(54) MULTI-USE FITNESS BAR SYSTEM

(71) Applicant: Alfred Sidney Smith, Jr., Sammamish, WA (US)

(72) Inventor: Alfred Sidney Smith, Jr., Sammamish, WA (US)

( * ) Notice: Subject to any disclaimer, the term of this patent is extended or adjusted under 35 U.S.C. 154(b) by 127 days.

(21) Appl. No.: 18/071,483

(22) Filed: Nov. 29, 2022

Related U.S. Application Data

(60) Provisional application No. 63/284,234, filed on Nov. 30, 2021.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/06*** | (2006.01) |

(52) U.S. Cl.
CPC ..... *A63B 21/4035* (2015.10); *A63B 21/04* (2013.01); *A63B 21/0557* (2013.01); *A63B 21/0609* (2013.01); *A63B 21/4043* (2015.10)

(58) Field of Classification Search
CPC ..... A63B 21/072–0783; A63B 21/02–0557
See application file for complete search history.

(56) References Cited

U.S. PATENT DOCUMENTS 2,470,815 A * 5/1949 Roosevelt ..... A63B 21/075 482/106
3,524,644 A * 8/1970 Kane ..... A63B 21/04 482/145
3,690,655 A * 9/1972 Chapman ..... A63B 23/14 482/109
4,304,402 A * 12/1981 Ripp ..... A63B 21/055 482/125
4,579,337 A * 4/1986 Uyeda ..... A63B 21/0728 403/259
4,722,523 A * 2/1988 Yang ..... A63B 17/04 482/40

(Continued)

FOREIGN PATENT DOCUMENTS

CA 3060699 A1 * 6/2020 ..... A63B 21/0728
KR 20170050795 A * 5/2017
KR 20210001111 U * 5/2021

OTHER PUBLICATIONS

"X3 Bar" downloaded on Nov. 29, 2022 from Internet site: https://www.jaquishbiomedical.com/x3-bar/?msclkid=b18a9103b35618dd004df28515d7f8e8.

*Primary Examiner* — Nyca T Nguyen
(74) *Attorney, Agent, or Firm* — QuickPatents; Kevin Prince

(57) ABSTRACT

A fitness bar system for use with exercise equipment, such as standard weights, Olympic weights, flat resistance bands, chains, tubular resistance bands, or the like, includes at least one elongated fitness bar having two opposing ends, each end being open and having an internal thread. At least one elongated cylindrical connector has two opposing ends, a threaded outside surface, and a plurality of threaded diametrical through holes each having threads. At least one adapter is fixable with the ends of each elongated fitness bar or with the ends of each of the elongated cylindrical connectors. The at least one adaptor is configured for connecting the fitness bar system with the exercise equipment. Multiple of the elongated fitness bars may be mutually connected with the elongated cylindrical connectors to form a fitness bar of several desired length.

15 Claims, 9 Drawing Sheets

(56) References Cited

U.S. PATENT DOCUMENTS 4,738,446 A * 4/1988 Miles ..... A63B 21/0728 24/580.11
4,787,629 A * 11/1988 DeMyer ..... A63B 21/0728 403/261
4,955,603 A * 9/1990 Becker ..... A63B 21/0728 403/259
5,328,431 A * 7/1994 Winslow ..... A63B 21/072 482/106
5,346,449 A * 9/1994 Schlagel ..... A63B 21/0728 482/107
5,549,532 A * 8/1996 Kropp ..... A63B 21/1609 482/122
6,120,424 A * 9/2000 Arline ..... A63B 21/169 482/121
6,402,668 B1 * 6/2002 Harker ..... A63B 21/0552 482/121
6,592,499 B2 * 7/2003 Parker ..... A63B 21/0722 482/106
7,131,938 B2 * 11/2006 Cao ..... A63B 21/075 482/106
7,163,496 B1 * 1/2007 Trotter ..... A63B 21/4035 482/126
7,364,536 B2 * 4/2008 Cappellini ..... A63B 21/0728 482/106
7,931,572 B1 * 4/2011 Glauser ..... A63B 21/0004 482/126
8,047,974 B1 * 11/2011 Kanelos ..... A63B 21/08 482/106
9,126,075 B2 * 9/2015 Tomaszewski .... A63B 21/0724
9,327,159 B1 * 5/2016 Medina ..... A63B 21/0726
9,352,184 B2 * 5/2016 Davis ..... A63B 21/0004
9,919,176 B2 * 3/2018 Christie ..... A63B 21/00061
10,874,896 B1 * 12/2020 Little ..... A63B 21/0442
11,110,314 B1 * 9/2021 Wineman ..... A63B 23/1209
2004/0009826 A1 * 1/2004 Aisenberg ..... A63B 69/3632 473/256
2004/0063554 A1 * 4/2004 Wince ..... A63B 21/0724 482/109
2004/0198568 A1 * 10/2004 Stonecipher ..... A63B 21/0023 482/106
2005/0113220 A1 * 5/2005 Dovner ..... A63B 21/0552 482/121
2007/0123398 A1 * 5/2007 Ljevaja ..... A63B 15/00 482/107
2008/0051262 A1 * 2/2008 Striar ..... A63B 21/075 482/93
2010/0227747 A1 * 9/2010 Cook ..... A63B 21/4035 482/112
2011/0021327 A1 * 1/2011 Lien ..... A63B 21/0728 482/107
2012/0021877 A1 * 1/2012 Lundquist ..... A63B 21/0728 482/107
2013/0196830 A1 * 8/2013 Pfitzer ..... A63B 21/0603 482/110
2014/0221174 A1 * 8/2014 Lin ..... A63B 21/075 482/107
2016/0038781 A1 * 2/2016 Christie ..... A63B 21/00061 482/121
2016/0096061 A1 * 4/2016 Sanders ..... A63B 21/00065 482/122
2017/0021219 A1 * 1/2017 Kelly ..... A63B 21/4033
2017/0203145 A1 * 7/2017 Proudian ..... A63B 21/4023
2018/0326245 A1 * 11/2018 Davis ..... A63B 26/003
2020/0069994 A1 * 3/2020 Plumbar ..... A63B 21/0442
2021/0016127 A1 * 1/2021 Freig ..... A63B 21/0728
2022/0062683 A1 * 3/2022 Zhang ..... A63B 21/0722
2022/0184443 A1 * 6/2022 Mehrgan ..... A63B 21/075
2022/0257992 A1 * 8/2022 Reed, III ..... A63B 21/0724
2022/0387843 A1 * 12/2022 Pasternak ..... A63B 21/4035
2024/0131379 A1 * 4/2024 Til ..... A63B 21/4045

* cited by examiner

MULTI-USE FITNESS BAR SYSTEM

CROSS-REFERENCE TO RELATED APPLICATIONS

This application claims the benefit of U.S. Provisional Patent Application 63/284,234, filed on Nov. 29, 2021, and is incorporated herein by reference.

STATEMENT REGARDING FEDERALLY SPONSORED RESEARCH AND DEVELOPMENT

Not Applicable.

FIELD OF THE INVENTION

This invention relates to exercise equipment, and more particularly to a multi-use fitness bar.

BACKGROUND

When performing fitness exercises, the use of a fitness bar is frequently required. Such a fitness bar is typically a metallic rigid rod or pole onto which weights or resistance bands are applied. Different exercises may require a different size fitness bars or connection mechanisms in order to be performed. However, it is impractical to purchase a single bar for each type of exercise required. Further, splitting a bar into multiple sections has weakened prior art fitness bars at their joints.

Therefore, there is a need for a fitness bar device that is easily configurable into different lengths as desired for particular exercises, all while maintaining the strength of the fitness bar. Such a needed invention would provide for various adapters easily attachable to the fitness bar, each adapter suited for use with specific types of exercise equipment, such as Olympic weights and various types and styles of resistance bands. The present invention accomplishes these objectives.

SUMMARY OF THE INVENTION

The present device is a fitness bar system for use with exercise equipment, such as standard weights, Olympic weights, flat resistance bands, chains, tubular resistance bands, or the like. A person may utilize the fitness bar system in isolation, or connected with another piece of exercise equipment, such as an exercise machine, via the resistance bands, for example.

The fitness bar system includes at least one elongated fitness bar having two opposing ends, each end being open and having an internal thread. In some embodiments, the at least one elongated fitness bar includes a knurled outer surface.

The fitness bar system further includes at least one elongated cylindrical connector having two opposing ends, a threaded outside surface, and a plurality of threaded diametrical through holes each having threads. In some embodiments the at least one elongated cylindrical connector has a standard diameter of about one inch for receiving sports equipment that takes the form of standard weights. As such, multiple of the elongated fitness bars may be mutually connected with the elongated cylindrical connectors to form a fitness bar of several different lengths.

At least one adapter is fixable with the ends of each elongated fitness bar or with the ends of each of the elongated cylindrical connectors. The at least one adaptor is configured for connecting the fitness bar system with the exercise equipment. For example, the at least one adapter may include an Olympic weight adapter for receiving Olympic weights that have a diameter of about two inches. The at least one adapter may include at least one threaded collar configured for threadably engaging each of the at least one elongated connectors. Such a threaded collar includes a transverse aperture therethrough that is alignable with any of the diametrical through holes of each elongated cylindrical connector. At least one flat band hook or chain eyelet, each having a threaded shaft, may further be included, each configured for threadably connecting with both the transverse aperture of the at least one threaded collar and any of the diametrical through holes of the at least one elongated cylindrical connector. Each flat band hook is configured for receiving the flat-type resistance band, and each chain eyelet is configured for receiving a chain or a tubular resistance band.

In some embodiments, the at least one adapter includes an adjustable resistance band buckle configured for securing one end of the flat resistance band therein at a desired point selected by the person. The adjustable resistance band buckle has a top end that is adapted for securing with the at least one elongated cylindrical connector, through either a first transverse aperture or a second transverse aperture.

The present invention is a fitness bar system that is easily configurable into different lengths as desired for particular exercises, all while maintaining the strength of the fitness bar. The present system provides for various adapters easily attachable to the fitness bar, each adapter suited for use with specific types of exercise equipment, such as Olympic weights and various types and styles of resistance bands. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
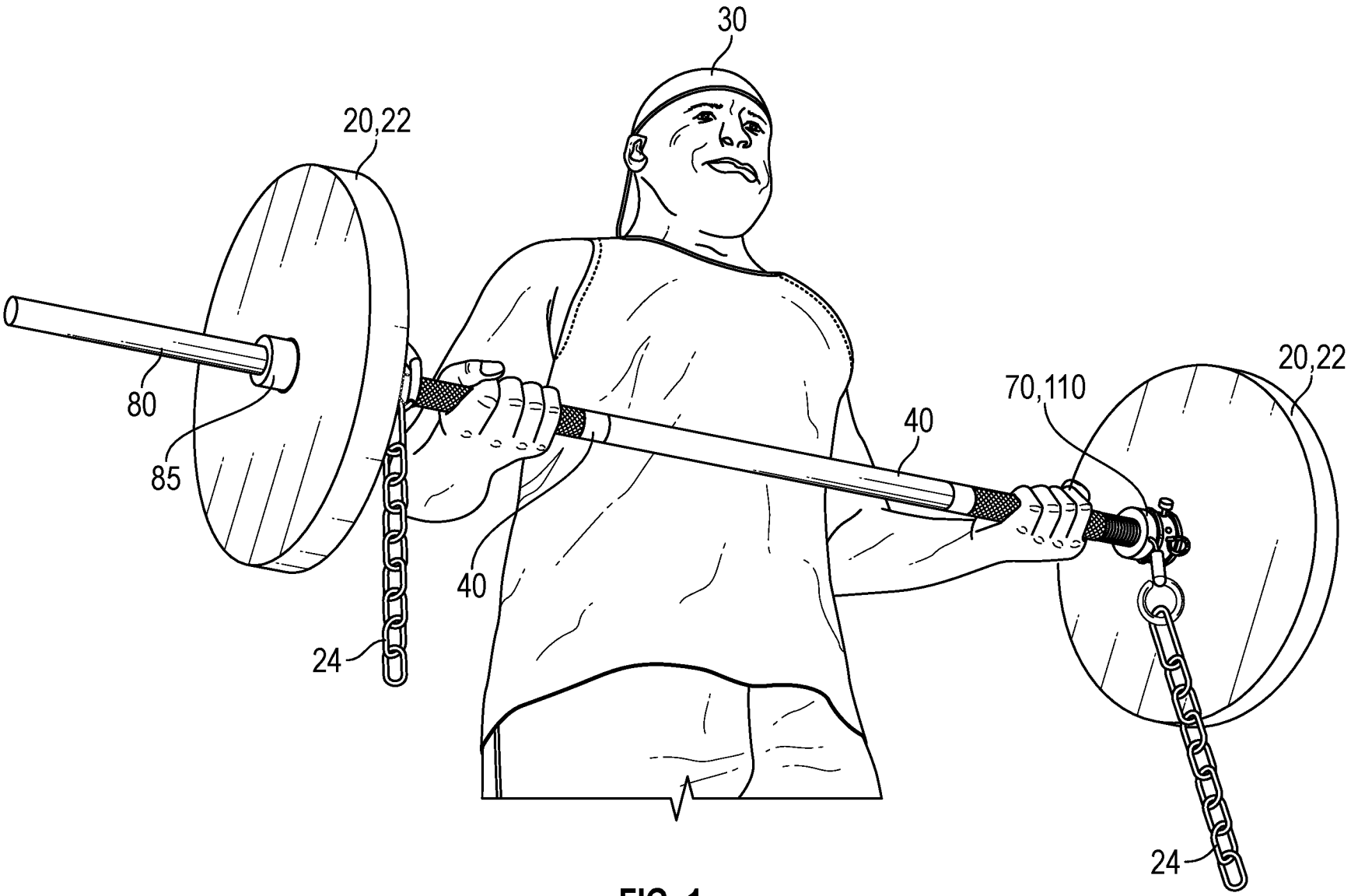
FIG. 1 is a perspective view of the invention.
Figure 2:
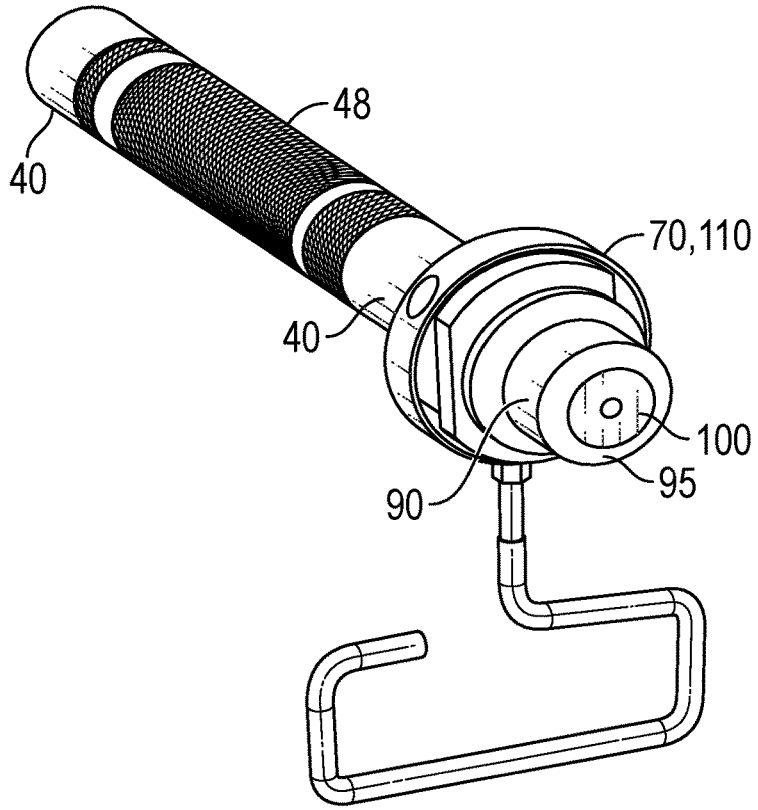
FIG. 2 is a partial side perspective view of the invention, illustrated with a threaded collar adapter fixed with a flat band hook.
Figure 3:
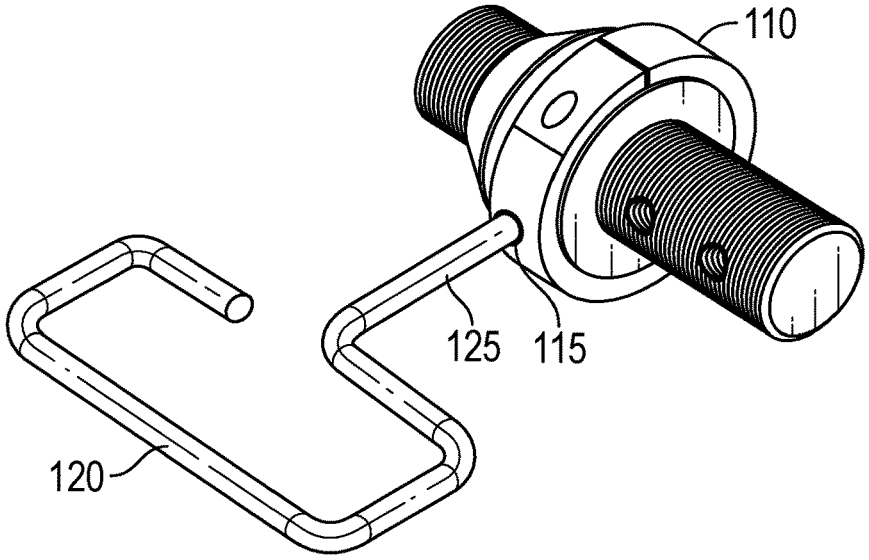
FIG. 3 is a partial perspective view of the threaded collar adapter fixed with the flat band hook for use with flat resistance bands.
Figure 4:
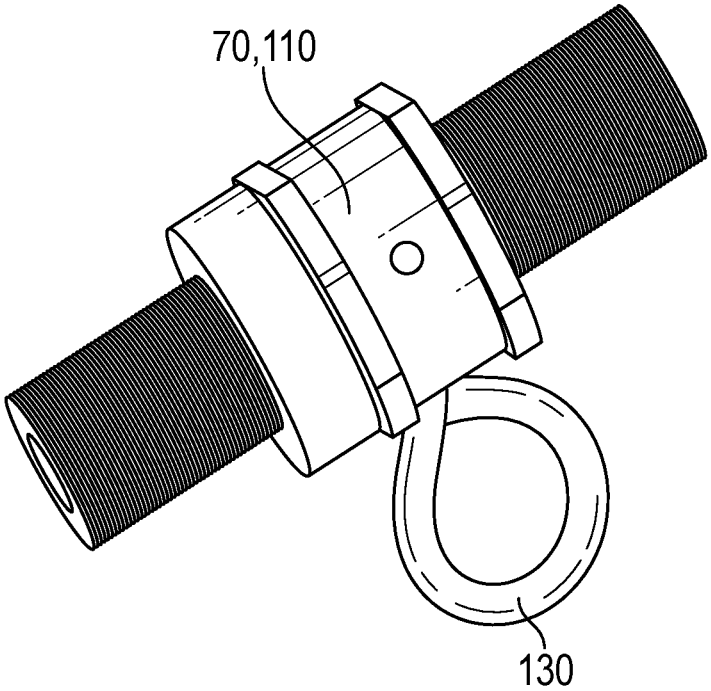
FIG. 4 is a partial perspective view of the threaded collar adapter fixed with a chain eyelet for use with chains or tubular resistance bands.
Figure 5:
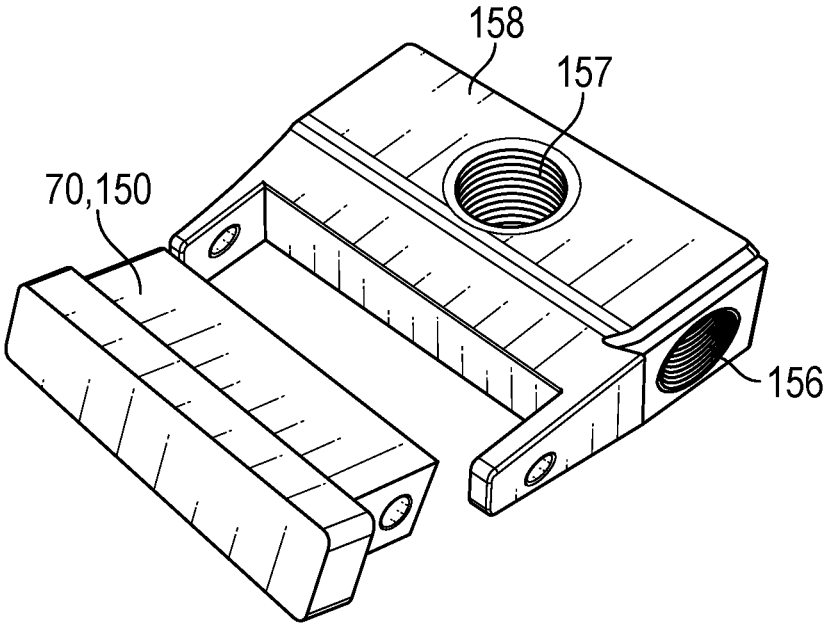
FIG. 5 is a partial exploded perspective view of an adjustable resistance band buckle type adapter for use with flat resistance bands having two opposing ends.
Figure 6:
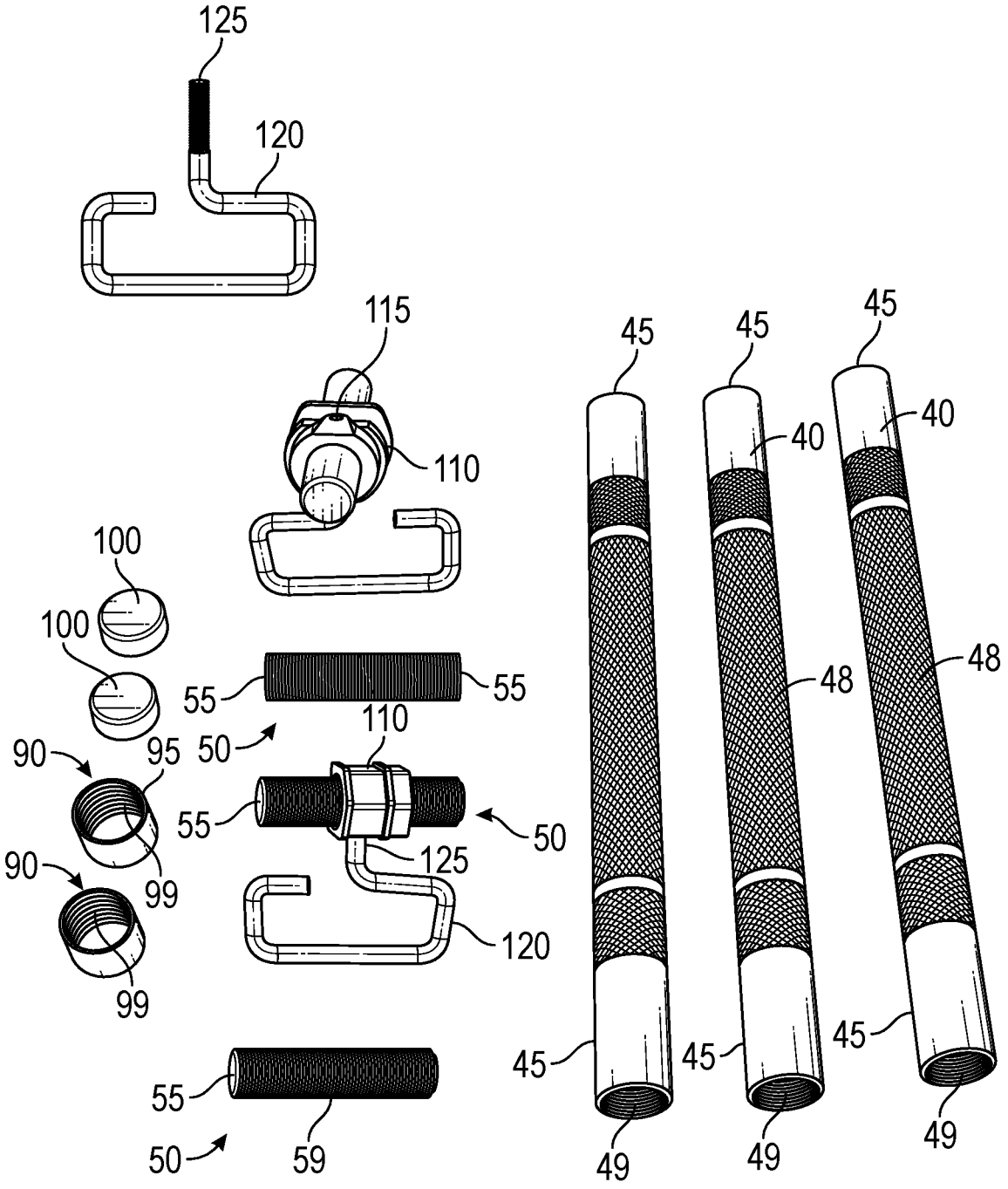
FIG. 6 is an exploded perspective view of the fitness bar system and several components thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-6 illustrate a fitness bar system 10 for use with exercise equipment 20, such as standard weights (not shown), Olympic weights 22, flat resistance bands 23, chains 24, tubular resistance bands (not shown), or the like. A person 30 may use the fitness bar system 10 in isolation, or connected with another piece of exercise equipment 20, such as an exercise machine (not shown), via the resistance bands 23, for example.

The fitness bar system 10 includes at least one elongated fitness bar 40 having two opposing ends 45, each end 45 being open and having an internal thread 49. Such an elongated fitness bar 40 is preferably made from a strong and rigid metal material, such as steel. In some embodiments, the at least one elongated fitness bar 40 includes a knurled outer surface 48.

Figure 9:
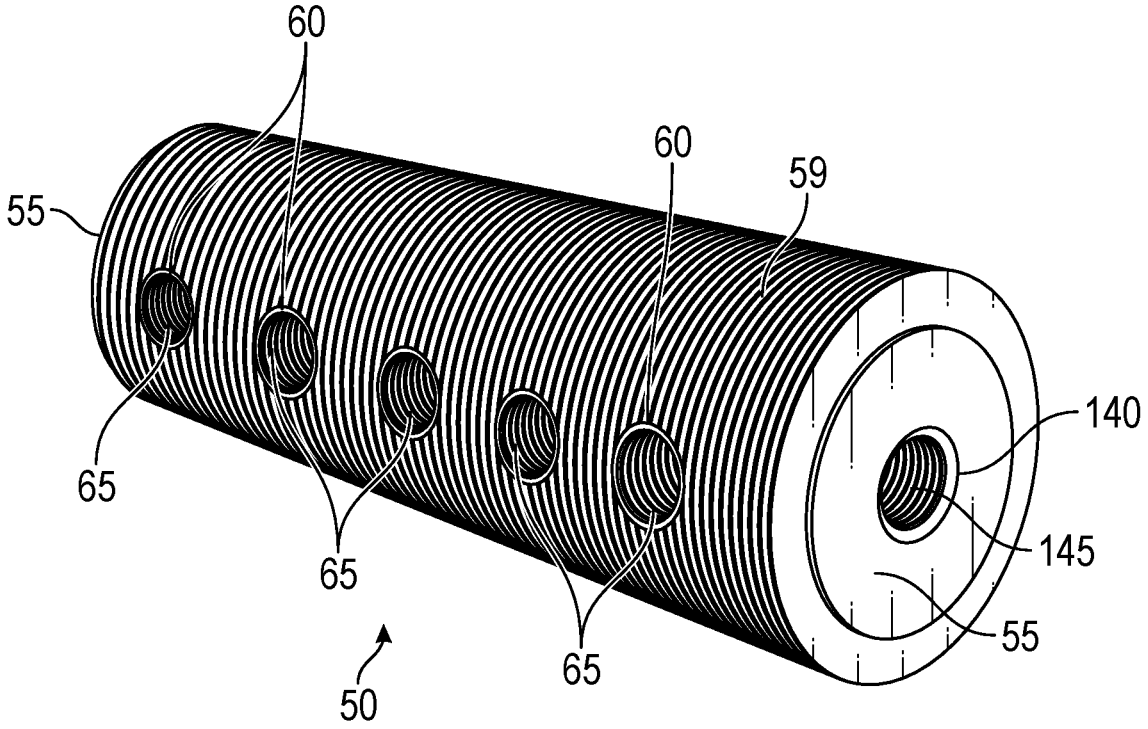
FIG. 9 is an enlarged perspective view of one of an elongated cylindrical connectors of the invention.

The fitness bar system 10 further includes at least one elongated cylindrical connector 50 (FIG. 9) having two opposing ends 55, a threaded outside surface 59, and a plurality of threaded diametrical through holes 60 each having threads 65. Preferably each elongated cylindrical connector 50 includes five of the diametrical through holes 60 spaced evenly therealong. In some embodiments the at least one elongated cylindrical connector 50 has a standard diameter of about one inch for receiving sports equipment 20 that takes the form of standard weights (not shown). Preferably each elongated cylindrical connector 50 is made from a strong metallic material, such as steel. Multiple of the elongated fitness bars 40 may be mutually connected with the elongated cylindrical connectors 50 to form a fitness bar of several different, desired lengths.

At least one adapter 70 is fixable with the ends 45 of each elongated fitness bar 40 or with the ends 55 of each of the elongated cylindrical connectors 50. The at least one adaptor is configured for connecting the fitness bar system 10 with the exercise equipment 20.

Figure 10:
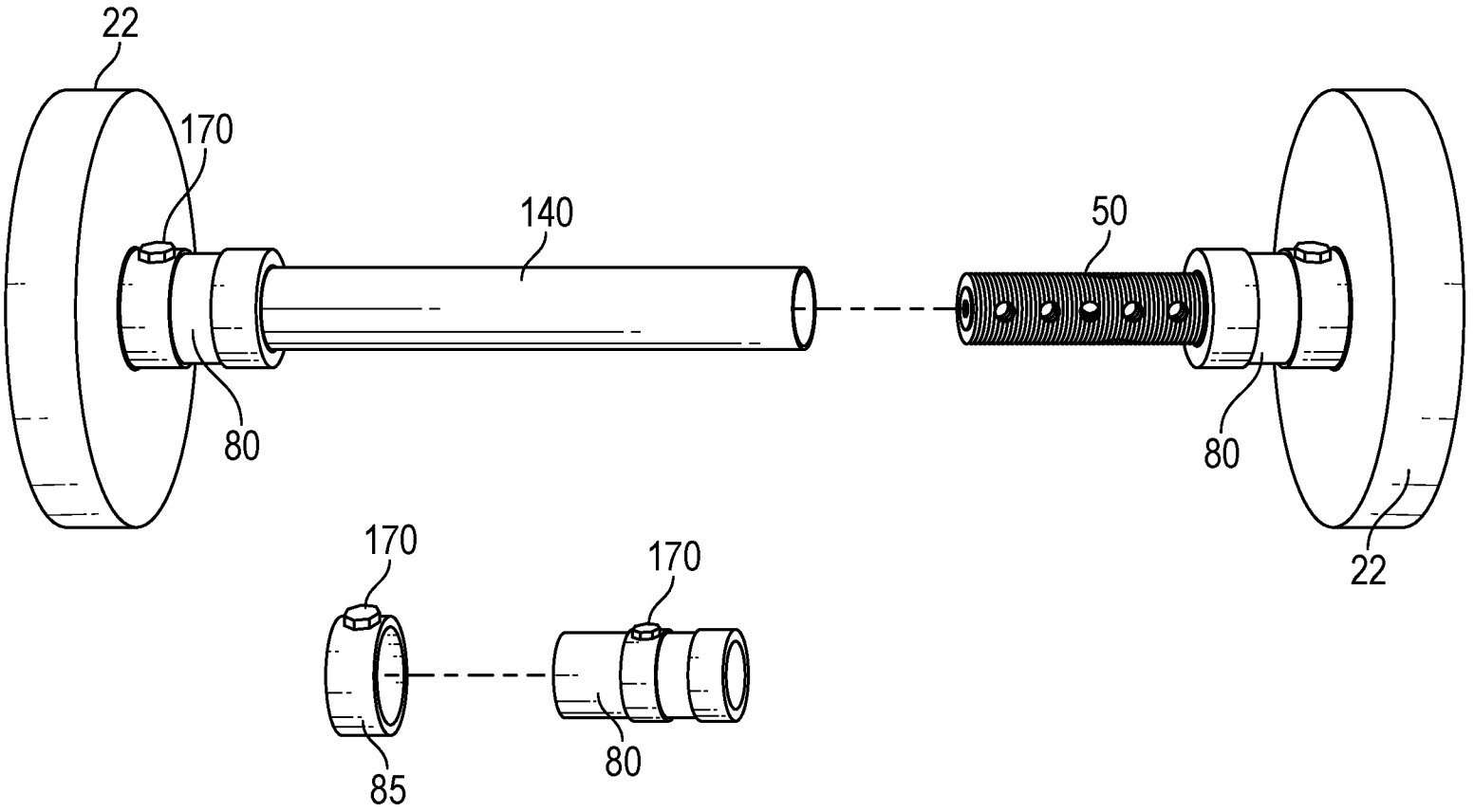
FIG. 10 is a partially exploded perspective view of the invention, illustrating an Olympic weight adapter for use with Olympic style weights.

In preferred embodiments of the invention, the at least one adapter 70 includes an Olympic weight adapter 80 (FIGS. 1 and 10) for receiving sports equipment 20 that takes the form of Olympic weights 22 that have a diameter of about two inches. A locking collar 85 is configured for selectively retaining the Olympic weights 22 on the Olympic weight adapter 80. A mechanical fastener 170, such as a bolt or screw, secures the locking collar 85 to one of the diametrical through holes 60 of one of the elongated cylindrical connectors 50.

In preferred embodiments of the invention, the at least one adapter 70 further includes at least one threaded collar 110 configured for threadably engaging each of the at least one elongated connectors 50. Such a threaded collar 110 includes a transverse aperture 115 therethrough that is alignable with any of the diametrical through holes 60 of each elongated cylindrical connector 50. As such, exercise equipment 20 in the form of standard weights (not shown) can be held onto the fitness bar system 10 and restrained by each threaded collar 110.

Figure 7:
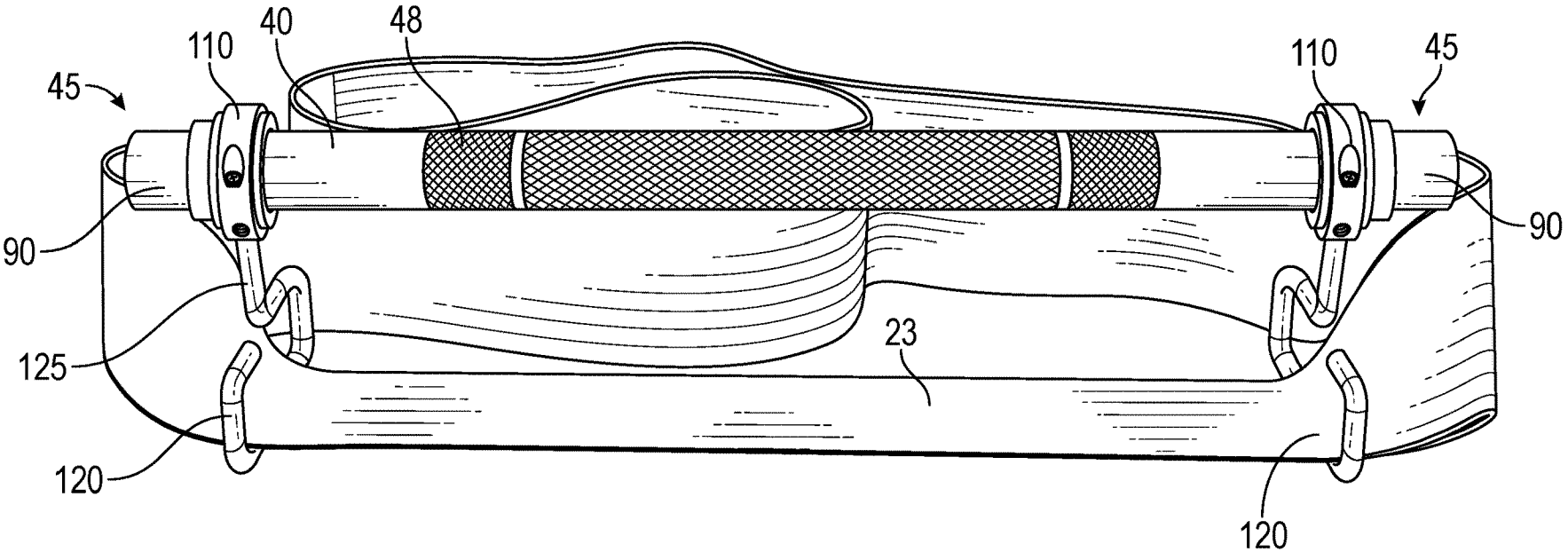
FIG. 7 is a perspective view of the fitness bar with the threaded collars and the flat band hooks.

Further, at least one flat band hook 120 having a threaded shaft 125 can be included, configured for threadably connecting with both the transverse aperture 115 of the at least one threaded collar 110 and any of the diametrical through holes 60 of the at least one elongated cylindrical connector 50. Each flat band hook 125 is configured for receiving exercise equipment in the form of the flat-type resistance band 23 (FIG. 7). In addition, a chain eyelet 130 having a threaded shaft 135 is included that can be threadably connected with both the transverse aperture 115 of the at least one threaded collar 110 and any of the diametrical through holes 60 of the at least one elongated cylindrical connector 50. Such a chain eyelet 130 is configured for receiving the exercise equipment 20 in the form of a chain 24 or of a tubular resistance band (not shown) as is known in the art.

Preferably the fitness bar system 10 further includes two fitness bar end caps 90, each configured for threading onto either end 55 of each of the elongated cylindrical connectors 50. Each fitness bar end cap 90 includes internal threads 99 adapted for cooperating the with threaded outer surface 59 of the at least one elongated cylindrical connector 50. In some embodiments each fitness bar end cap 90 includes an end aperture 95 therethrough, and in such embodiments two elastomeric or plastic caps 100 are included for selectively sealing the end aperture 95 by insertion into the fitness bar end caps 90 before the fitness bar end caps 90 are screwed onto the elongated cylindrical connectors 50.

Figure 11:
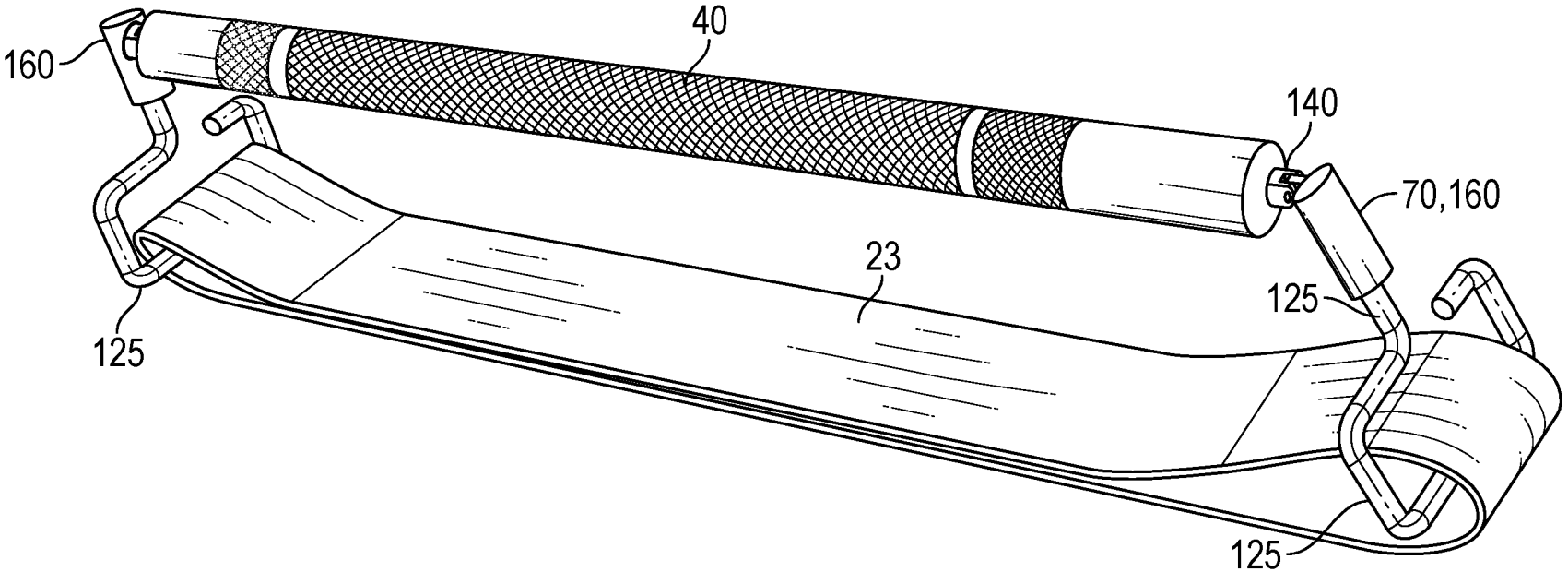
FIG. 11 is a perspective view showing two rotational connector adapters each fixed with one of the flat band hooks and used with a flat resistance band.

In some embodiments, one or more of the elongated cylindrical connectors 50 includes a threaded longitudinal bore 140 at each end thereof, each longitudinal bore 140 having threads 145. As such, the at least one flat band hook 120 or one of the chain eyelets 130 can be threadably connected with the bore 140 of the at least one elongated cylindrical connector 50. In some embodiments, the at least one adapter 70 may include a rotational connector 160 (FIG. 11) such that the flat band hook 125 can hand downwardly relative to the elongated fitness bar 40 held horizontally.

Figure 8:
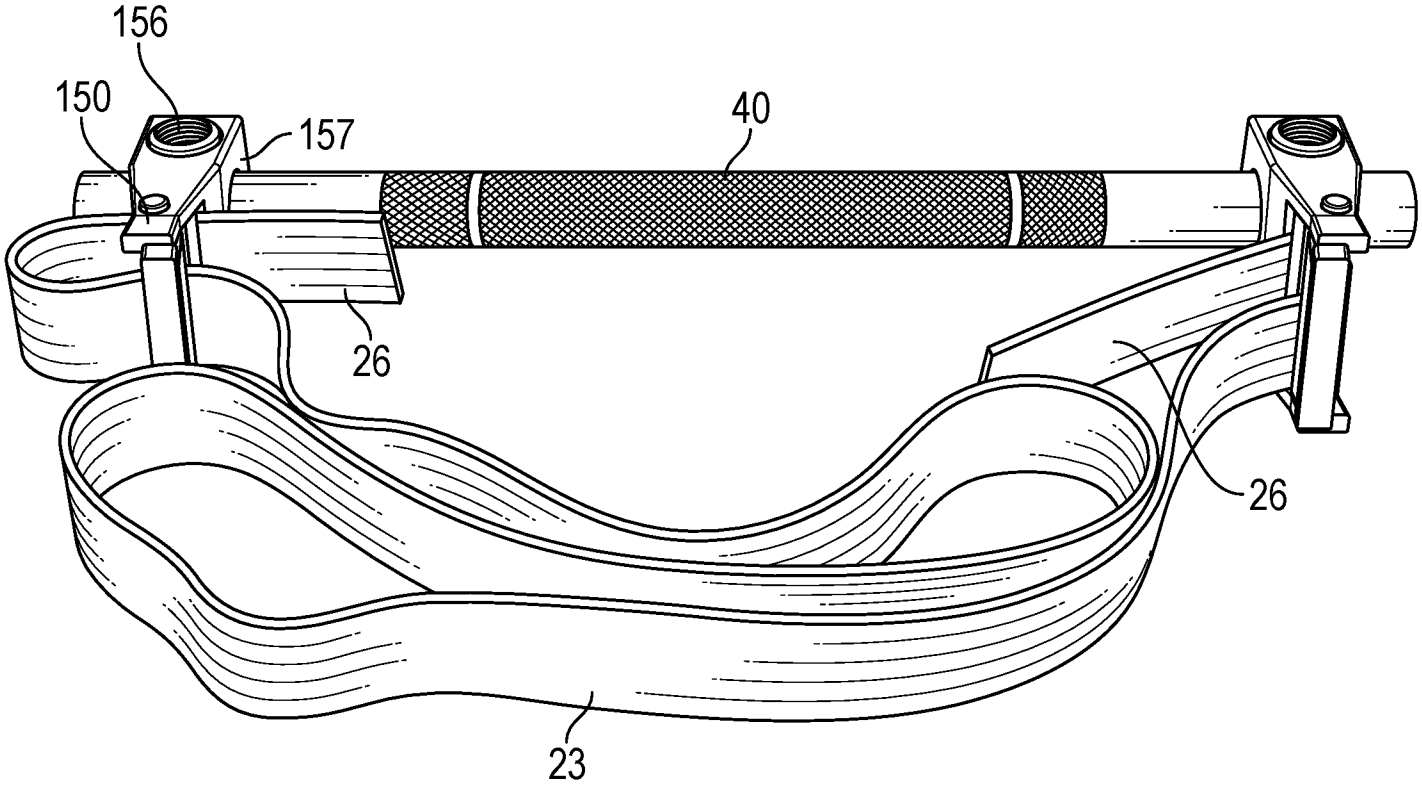
FIG. 8 is a perspective view of the fitness bar with the adjustable resistance band buckle type adapter and the flat resistance band having two opposing ends.

In some embodiments, the at least one adapter 70 includes an adjustable resistance band buckle 150 (FIG. 5) configured for securing one end 26 (FIG. 8) of the flat resistance band 23 therein at a desired point selected by the person 30. The adjustable resistance band buckle 150 has a top end 158 that is adapted for securing with the at least one elongated cylindrical connector 50, through either a first transverse aperture 157 (FIG. 8), or a second transverse aperture 156. Preferably each adapter 70 is made from a strong metallic material, such as steel or iron.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A fitness bar system for use with exercise equipment, comprising:

at least one elongated fitness bar having two opposing ends, each end being open and having an internal thread;

at least one elongated cylindrical connector having two opposing ends, a threaded outside surface, and a plurality of diametrical through holes each with threads;

at least one adapter fixable with the ends of either the at least one elongated fitness bar or the at least one elongated cylindrical connector, the at least one adaptor configured for connecting the fitness bar system with the exercise equipment, wherein the at least one elongated fitness bar has a standard diameter for receiving sports equipment that takes the form of standard weights, and wherein the at least one adapter includes an Olympic weight adapter for sports equipment that takes the form of Olympic weights, the Olympic weight adapter including a locking collar configured for selectively retaining the Olympic weights on the Olympic weight adapter.

2. The fitness bar system of claim 1 wherein the at least one elongated fitness bar includes a knurled outer surface.

3. The fitness bar system of claim 1 wherein the at least one elongated cylindrical connector includes five of the diametrical through holes spaced evenly therealong.

4. A fitness bar system for use with exercise equipment, comprising:

at least one elongated fitness bar having two opposing ends, each end being open and having an internal thread;

at least one elongated cylindrical connector having two opposing ends, a threaded outside surface, and a plurality of diametrical through holes each with threads;

at least one adapter fixable with the ends of either the at least one elongated fitness bar or the at least one elongated cylindrical connector, the at least one adaptor configured for connecting the fitness bar system with the exercise equipment;

two fitness bar end caps each configured for threading onto either end of each of the elongated cylindrical connectors.

5. The fitness bar system of claim 4, wherein each fitness bar end cap includes an end aperture therethrough.

6. The fitness bar system of claim 5 further including elastomeric caps configured for frictionally fitting into each fitness bar end cap to occlude the end aperture of the fitness bar end cap.

7. A fitness bar system for use with exercise equipment, comprising:

at least one elongated fitness bar having two opposing ends, each end being open and having an internal thread;

at least one elongated cylindrical connector having two opposing ends, a threaded outside surface, and a plurality of diametrical through holes each with threads;

at least one adapter fixable with the ends of either the at least one elongated fitness bar or the at least one elongated cylindrical connector, the at least one adaptor configured for connecting the fitness bar system with the exercise equipment;

wherein the at least one adapter includes at least one threaded collar configured for threadably engaging each of the at least one elongated cylindrical connector and having a transverse aperture therethrough alignable with any of the diametrical through holes of each elongated cylindrical connector, whereby exercise equipment in the form of standard weights is configured to be held onto the fitness bar system and restrained by each threaded collar.

8. The fitness bar system of claim 7 further including at least one flat band hook having a threaded shaft adapted for threadably connecting with both the transverse aperture of the at least one threaded collar and any of the diametrical through holes of the at least one elongated cylindrical connector, each flat band hook configured for receiving exercise equipment in the form of a flat-type resistance band.

9. The fitness bar system of claim 7 further including at least one chain eyelet having a threaded shaft adapted for threadably connecting with both the transverse aperture of the at least one threaded collar and any of the diametrical through holes of the at least one elongated cylindrical connector, each chain eyelet configured for receiving exercise equipment in the form of a chain or a tubular resistance band.

10. A fitness bar system for use with exercise equipment, comprising:

at least one elongated fitness bar having two opposing ends, each end being open and having an internal thread;

at least one elongated cylindrical connector having two opposing ends, a threaded outside surface, and a plurality of diametrical through holes each with threads;

at least one adapter fixable with the ends of either the at least one elongated fitness bar or the at least one elongated cylindrical connector, the at least one adaptor configured for connecting the fitness bar system with the exercise equipment;

wherein each elongated cylindrical connector has at each end thereof a longitudinal bore with threads.

11. The fitness bar system of claim 10 further including at least one flat band hook having a threaded shaft adapted for threadably connecting with the bore of the at least one elongated cylindrical connector, each flat band hook configured for receiving exercise equipment in the form of a flat-type resistance band.

12. The fitness bar system of claim 10 further including at least one chain eyelet having a threaded shaft adapted for threadably connecting with the bore of the at least one elongated cylindrical connector, each chain eyelet configured for receiving exercise equipment in the form of a chain or a tubular resistance band.

13. A fitness bar system for use with exercise equipment, comprising:

at least one elongated fitness bar having two opposing ends, each end being open and having an internal thread;

at least one elongated cylindrical connector having two opposing ends, a threaded outside surface, and a plurality of diametrical through holes each with threads;

at least one adapter fixable with the ends of either the at least one elongated fitness bar or the at least one elongated cylindrical connector, the at least one adaptor configured for connecting the fitness bar system with the exercise equipment;

wherein the at least one adapter includes an adjustable resistance band buckle configured for securing one end of a flat resistance band therein at a desired point, the adjustable resistance band buckle having a top end adapted for securing with the at least one elongated cylindrical connector.

14. The fitness bar system of claim 13 wherein the top end of the adjustable resistance band buckle includes a first transverse aperture therethrough.

15. The fitness bar system of claim 14 wherein the top end of the adjustable resistance band buckle includes a second transverse aperture therethrough, the second transverse aperture orthogonal to the first transverse aperture.

* * * * *